US010024332B2

(12) United States Patent
Ohtaguro

(10) Patent No.: US 10,024,332 B2
(45) Date of Patent: Jul. 17, 2018

(54) CENTRIFUGAL FAN AND AIR CONDITIONER PROVIDED WITH THE SAME

(71) Applicant: DAIKIN INDUSTRIES, LTD., Osaka-shi, Osaka (JP)

(72) Inventor: Ryuusuke Ohtaguro, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/025,711

(22) PCT Filed: Sep. 12, 2014

(86) PCT No.: PCT/JP2014/074229
§ 371 (c)(1),
(2) Date: Mar. 29, 2016

(87) PCT Pub. No.: WO2015/045907
PCT Pub. Date: Apr. 2, 2015

(65) Prior Publication Data

US 2016/0245298 A1 Aug. 25, 2016

(30) Foreign Application Priority Data

Sep. 30, 2013 (JP) ..... 2013-205128

(51) Int. Cl.
*F04D 29/30* (2006.01)
*F04D 25/08* (2006.01)
(Continued)

(52) U.S. Cl.
CPC ..... *F04D 29/30* (2013.01); *F04D 25/08* (2013.01); *F04D 25/088* (2013.01);
(Continued)

(58) Field of Classification Search
CPC ..... F05B 2250/182
See application file for complete search history.

(56) References Cited

U.S. PATENT DOCUMENTS 7,241,114 B2 * 7/2007 Koeppler ..... F04D 29/242 416/186 R
8,834,121 B2 * 9/2014 Ikeda ..... F04D 25/088 416/186 R
(Continued)

FOREIGN PATENT DOCUMENTS

EP 2131041 A1 12/2009
JP 2003-172297 A 6/2003
(Continued)

OTHER PUBLICATIONS

International Search Report issued in PCT/JP2014/074229 dated Dec. 2, 2014.
Written Opinion of the International Searching Authority issued in PCT/JP2014/074229 dated Dec. 2, 2014.

*Primary Examiner* — Logan Kraft
*Assistant Examiner* — Jason Davis
(74) *Attorney, Agent, or Firm* — Birch, Stewart, Kolasch & Birch, LLP

(57) ABSTRACT

In a centrifugal fan, when an angle defined by a tangential line to a camber line at an intersection point between the camber line and an arc around a rotation axis, and a tangential line to the arc at the intersection point on a blade cross section passing a front edge and a rear edge of a blade is a blade angle, the blade has at least one of a decreasing shape and a fixed shape. The decreasing shape is such that the blade angle decreases as the intersection point is shifted toward the rear edge on the camber line on a front edge side portion of a shroud side blade cross section. The fixed shape is such that the blade angle is fixed, even if the intersection point is shifted toward the rear edge on the camber line on the front edge side portion of the shroud-side blade cross section.

6 Claims, 11 Drawing Sheets

(51) Int. Cl.

| | |
|---|---|
| ***F04D 29/42*** | (2006.01) |
| ***F04D 29/66*** | (2006.01) |
| ***F04D 29/28*** | (2006.01) |
| ***F24F 1/00*** | (2011.01) |
| *F24F 13/06* | (2006.01) |

(52) U.S. Cl.

CPC ..... *F04D 29/281* (2013.01); *F04D 29/4213* (2013.01); *F04D 29/663* (2013.01); *F24F 1/0007* (2013.01); *F24F 1/0022* (2013.01); *F05D 2240/301* (2013.01); *F05D 2240/303* (2013.01); *F05D 2240/304* (2013.01); *F05D 2240/307* (2013.01); *F05D 2250/182* (2013.01); *F24F 2001/0037* (2013.01); *F24F 2013/0616* (2013.01)

(56) References Cited

U.S. PATENT DOCUMENTS

| | | | | |
|---|---|---|---|---|
| 2011/0023526 | A1* | 2/2011 | Ohyama | F04D 29/281<br>62/426 |
| 2013/0058783 | A1* | 3/2013 | Fukuda | F04D 25/0613<br>415/227 |

FOREIGN PATENT DOCUMENTS

| | | | |
|---|---|---|---|
| JP | 2007-0198268 | A | 8/2007 |
| JP | 2007-321643 | A | 12/2007 |
| JP | 2011-252424 | A | 12/2011 |

* cited by examiner

CENTRIFUGAL FAN AND AIR CONDITIONER PROVIDED WITH THE SAME

TECHNICAL FIELD

The present invention relates to a centrifugal fan, and an air conditioner provided with the same.

BACKGROUND ART

Conventionally, a centrifugal fan has been used as a fan of an indoor unit of an air conditioner. In the centrifugal fan, when an impeller is rotated by a fan motor, air is sucked into a case of the indoor unit through a suction port of the indoor unit. The sucked air is guided to an air suction port of a shroud of the impeller along an inner circumferential surface of a bell mouth. In the following, a stream of air guided to the air suction port along the inner circumferential surface of the bell mouth is called as a main stream.

The main stream of air is ejected to the outside (in a direction to be away from a rotation axis of the impeller) from the impeller by a plurality of blades arranged circumferentially between a hub and the shroud. A main part of the air ejected from the impeller is blown into the room through a blow-out port of the indoor unit. However, a part of the air ejected from the impeller is refluxed toward the bell mouth through a space between the outer circumferential surface of the shroud and the case within the case of the indoor unit. The refluxed air merges with the main stream while passing through a gap between the outer circumferential surface of the bell mouth and the inner circumferential surface of the shroud. In the following, a stream of air that is refluxed as described above, and merges with the main stream while passing through a gap between the outer circumferential surface of the bell mouth and the inner circumferential surface of the shroud is called as a reflux stream (a leakage stream).

The aforementioned reflux stream has a high air velocity. Therefore, when the reflux stream passing through the gap collides against the front edges of the blades, noise increases. Further, the reflux stream has large fluctuations in air velocity (air velocity is largely fluctuated). Therefore, the pressure generated on the blade surfaces near the reflux stream is likely to be unstable. Fluctuations in pressure on the blade surfaces are a factor of noise increase.

In particular, in a centrifugal fan having a reduced thickness accompanied by reduction of the thickness of an indoor unit, the channel of the main stream is narrowed. However, it is necessary to secure substantially the same volume of the main stream as the volume in an indoor unit in which the thickness is not reduced. In the centrifugal fan having a reduced thickness, the volume of the reflux stream tends to increase. Therefore, the ratio of the reflux stream with respect to the main stream increases. As a result, the influence of the reflux stream on the main stream increases. In view of the above, it is important to suppress the influence by the reflux stream.

Patent Literature 1 proposes a technique for reducing noise by reducing a reflux stream (a leakage stream). The centrifugal fan disclosed in Patent Literature 1 is provided with a plurality of main blades disposed between a hub and a shroud, and a plurality of small blades formed on the outer circumferential surface of the shroud, wherein the camber line of a shroud-side blade element of each of the main blades is concaved toward the pressure surface, or a front-edge side portion of a shroud-side blade element of each of the main blades with respect to the camber line is tilted in the rotating direction. Patent Literature 1 describes that a pressure raising effect by the small blades reduces a pressure difference between the region on the back surface of the shroud and the region of the bell mouth channel. This makes it possible to reduce the flow rate of the reflux stream, and to reduce the air velocity on the shroud side portion of the front-edge-side portion of each of the main blades. Further, Patent Literature 1 describes forming the shape of the main blades as described above allows for the streams to follow the main blades. Patent Literature 1 describes the aforementioned configuration makes it possible to reduce noise.

However, in the configuration of the centrifugal fan disclosed in Patent Literature 1, it may be impossible to sufficiently reduce the volume of the reflux stream, and it may be impossible to obtain a sufficient noise reduction effect. Further, in the configuration of the centrifugal fan disclosed in Patent Literature 1, the weight of the fan may increase by addition of the small blades, and the cost may also increase.

CITATION LIST

Patent Literature

Patent Literature 1: Japanese Unexamined Patent Publication No. 2007-198268

SUMMARY OF INVENTION

An object of the invention is to provide a centrifugal fan that enables to reduce noise due to a reflux stream, while suppressing an increase in the weight and the cost.

A centrifugal fan of the present invention comprises an impeller rotating around a rotation axis and a bell mouth guiding air to the impeller. The impeller includes a shroud provided to have a gap between the shroud and an end of the bell mouth in a circumferential direction and a plurality of blades arranged along a circumferential direction of the shroud, and assembled to the shroud.

In a blade cross section passing a front edge of the blade and a rear edge of the blade, when an angle between a tangential line to a camber line at an intersection point of the camber line and an arc around the rotation axis, and a tangential line to the arc at the intersection point is defined as a blade angle, the blade has at least one of a decreasing shape and a fixed shape. The decreasing shape being such that the blade angle decreases as the intersection point is shifted toward the rear edge side on the camber line in a portion of the front edge side in the blade cross section of the shroud side. The fixed shape being such that the blade angle is fixed even if the intersection point is shifted toward the rear edge side on the camber line in a portion of the front edge side in the blade cross section of the shroud side.

DESCRIPTION OF EMBODIMENTS

Figure 1:
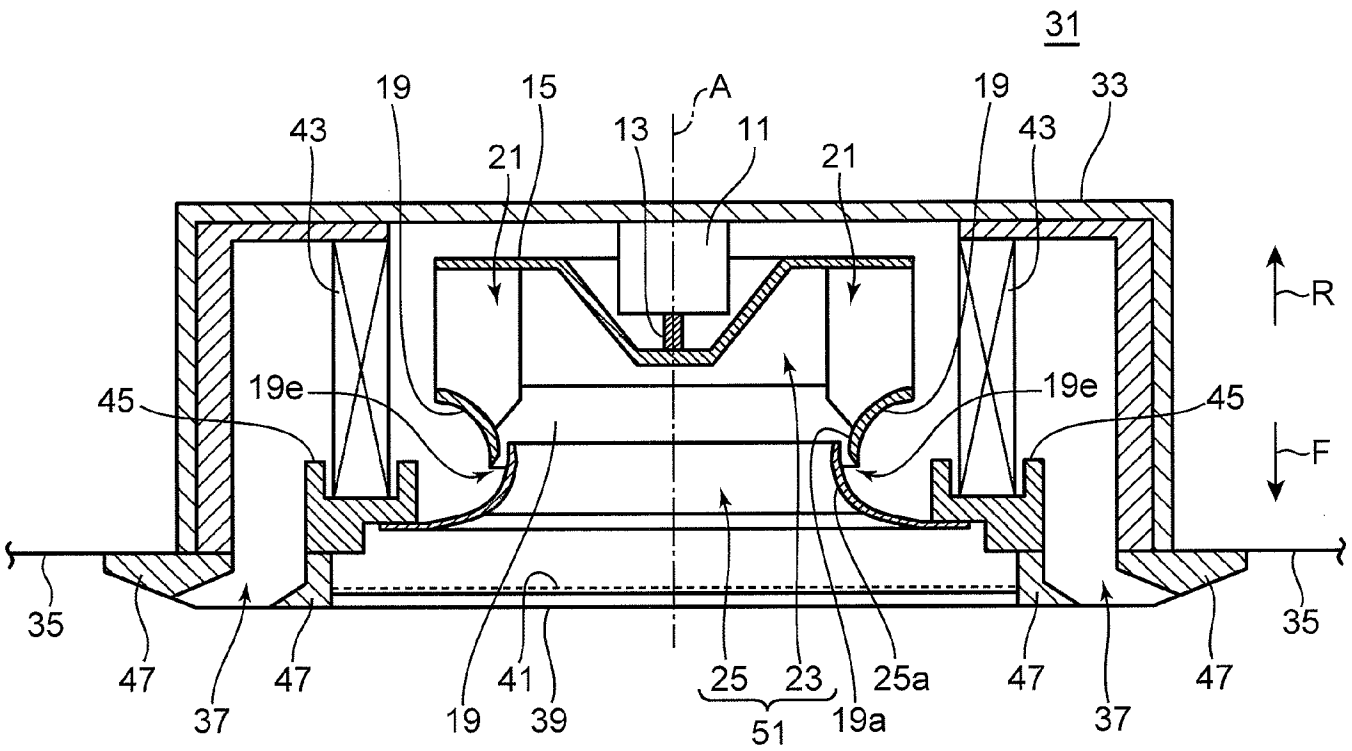
FIG. 1 is a sectional view illustrating an indoor unit provided with a centrifugal fan according to an embodiment of the present invention.

In the following, a centrifugal fan 51 according to one embodiment of the present invention, and an indoor unit 31 of an air conditioner provided with the centrifugal fan 51 are described referring to the drawings.

[Configuration of Indoor Unit of Air Conditioner]

Figure 2:
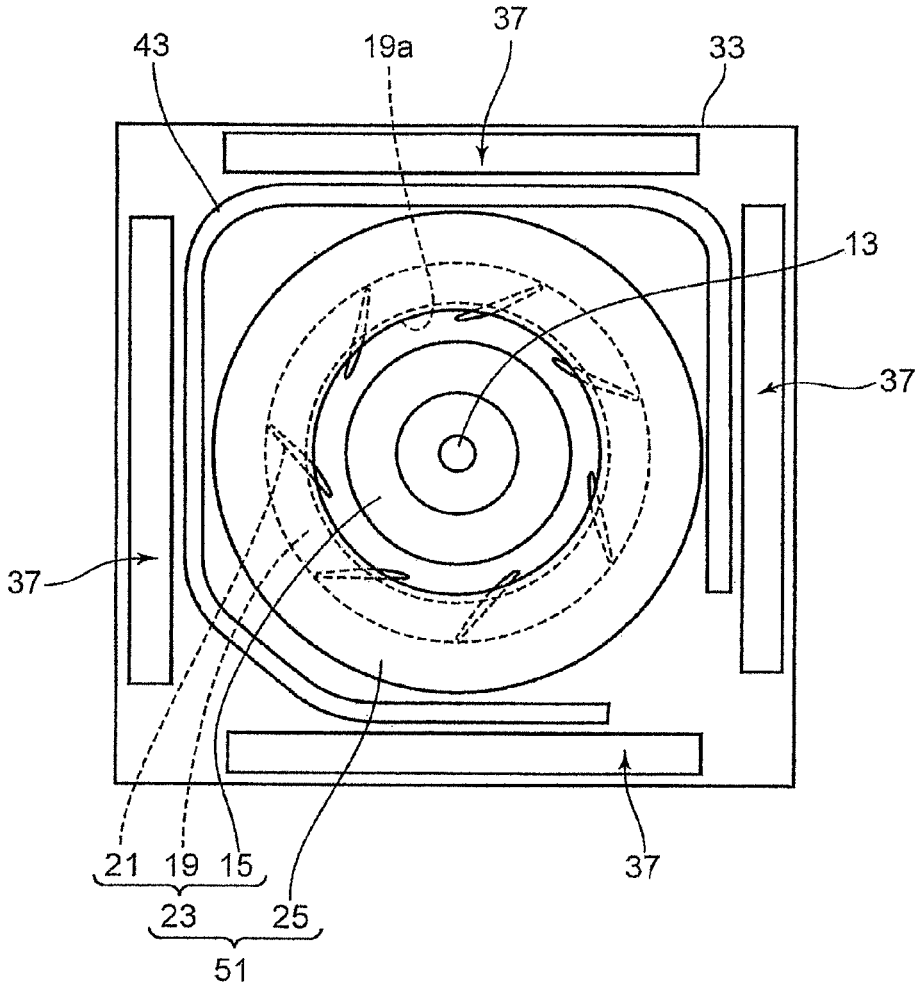
FIG. 2 is a bottom view illustrating a positional relationship between an impeller, a heat exchanger, and a blow-out port in the indoor unit.

The indoor unit 31 of the air conditioner in the embodiment illustrated in FIG. 1 and FIG. 2 is a cassette-type indoor unit embedded in a ceiling. The indoor unit 31 is provided with a substantially rectangular parallelepiped case 33 to be embedded in an opening formed in a ceiling 35, and a decorative panel 47 mounted on the lower portion of the case 33. The decorative panel 47 has a larger size than the case 33 in plan view, and is exposed inside the room in a state that the opening of the ceiling is covered. The decorative panel 47 has a rectangular suction port 39 formed in the middle of the decorative panel 47, and four elongated rectangular blow-out ports 37 formed along the respective sides of the suction port 39.

The indoor unit 31 is provided with a centrifugal fan (turbo fan) 51, a fan motor 11, a heat exchanger 43, a drain pan 45, and an air filter 41 within the case 33. The centrifugal fan 51 includes an impeller 23 and a bell mouth 25. The fan motor 11 is fixed substantially at the middle of a top plate of the case 33. A shaft 13 of the fan motor 11 extends in the up-down direction.

The heat exchanger 43 has a flat shape with a small thickness. The heat exchanger 43 is disposed to surround the periphery of the impeller 23 in a state that the heat exchanger 43 stands upright from the dish-shaped drain pan 45 extending along the lower end of the heat exchanger 43. The drain pan 45 accommodates water droplets generated in the heat exchanger 43. The accommodated water is discharged through an unillustrated drainage channel.

The air filter 41 has a size capable of covering the inlet of the bell mouth 25. The air filter 41 is disposed along the suction port 39 between the bell mouth 25 and the suction port 39. The air filter 41 traps dust in the air when the air sucked into the case 33 through the suction port 39 passes through the air filter 41.

The indoor unit 31 in the embodiment has a reduced thickness. Accompanied by thinning of the indoor unit 31, the thickness of the impeller 23 of the centrifugal fan 51 is also reduced in the rotation axis A direction. As a result, the indoor unit 31 has a structure such that noise is likely to occur due to a reflux stream C. Specifically, it is conceived that the flow rate of the reflux stream C is proportional to the size of a gap G, and a pressure difference (a pressure loss of the indoor unit). In the indoor unit 31 having a reduced thickness, the pressure difference is likely to increase, regardless that the size of the gap G is retained unchanged. This is because the air velocity increases and the pressure loss increases in order to obtain the same volume of air in the indoor unit 31 having a reduced thickness as in an indoor unit 31 in which the thickness is not reduced. As a result, the reflux stream C is likely to increase in the indoor unit 31 having a reduced thickness.

[Configuration of Centrifugal Fan]

Figure 3:
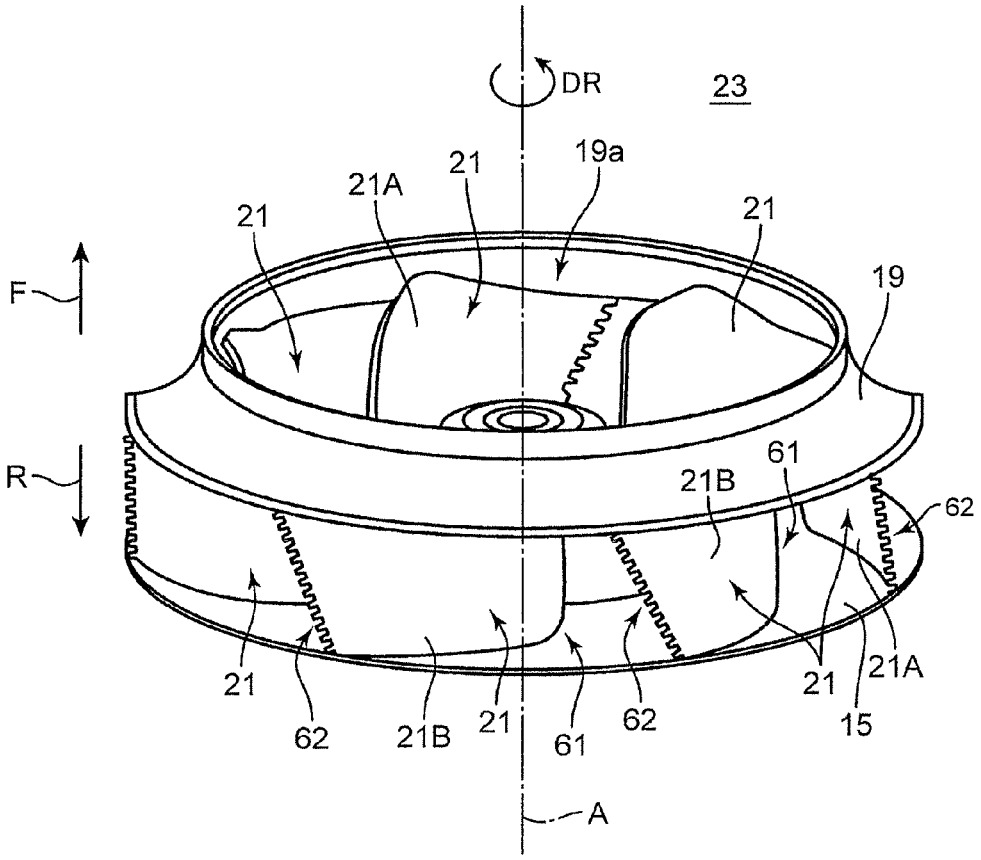
FIG. 3 is a perspective view illustrating the impeller of the centrifugal fan.

As illustrated in FIG. 1 to FIG. 3, the impeller 23 includes a hub 15, a shroud 19, and a plurality of blades 21. The impeller 23 rotates around the rotation axis A. The hub 15 is fixed to the lower end of the shaft 13 of the fan motor 11. The hub 15 has a circular shape around the rotation axis A in plan view.

The shroud 19 is disposed to face the front side F with respect to the hub 15 in the rotation axis A direction of the shaft 13. The shroud 19 includes an air suction port 19*a* opened in a circular shape around the rotation axis A. The outer diameter of the shroud 19 increases toward the rear side R in the rotation axis A direction.

As illustrated in FIG. 1, the bell mouth 25 is disposed to face the front side F with respect to the shroud 19 in the rotation axis A direction. The bell mouth 25 includes an opening 25*a* (suction port 25*a*) passing in the rotation axis A direction. A part of the bell mouth 25 on the rear side R is inserted into the shroud 19 through the air suction port 19*a* in a state that a predetermined gap is formed between the rear side part of the bell mouth 25, and a perimeter 19*e* of the air suction port 19*a* of the shroud 19. According to this configuration, the bell mouth 25 is operable to guide air sucked toward the rear side R through the opening 25*a* to the air suction port 19*a* of the shroud 19.

Figure 4:
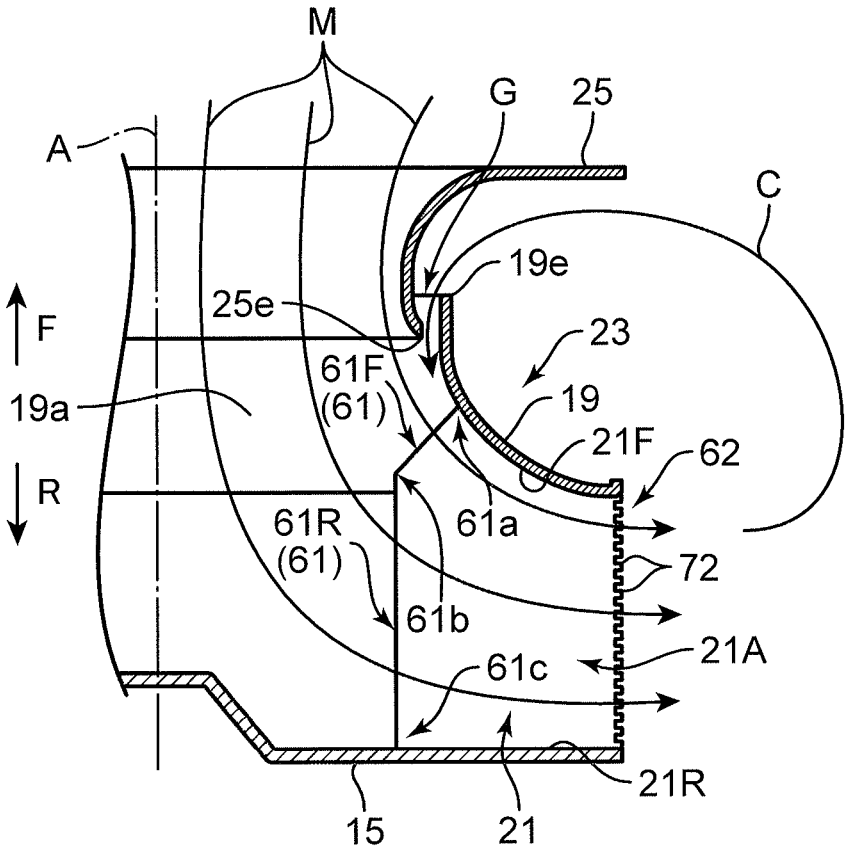
FIG. 4 is a sectional view for describing a main stream and a reflux stream.

As illustrated in FIG. 3, a plurality of blades 21 are arranged around the rotation axis A between the hub 15 and the shroud 19. Each of the blades 21 is a backward blade configured such that the blade 21 is tilted in the direction opposite to the rotational direction DR (tilted backward) radially of the hub 15. In the embodiment, each of the blades 21 has a three-dimensional shape such that the blade 21 extends in the rotation axis A direction while being twisted between the hub 15 and the shroud 19. Alternatively, each of the blades 21 may not be twisted as described above. As illustrated in FIG. 3 and FIG. 4, a rear edge 62 of each of the blades 21 has a plurality of concavity and convexity 72. The concavity and convexity 72 may be omitted.

As illustrated in FIG. 3, FIG. 4, FIG. 5A, and FIG. 5B, each of the blades 21 includes a negative pressure surface 21A (blade inner surface 21A) facing radially inward of the impeller 23, a positive pressure surface 21B (blade outer surface 21B) facing radially outward of the impeller 23, a front edge 61 as a front side edge when the impeller 23 is rotated, and the rear edge 62 as a rear side edge when the impeller 23 is rotated. Further, an end edge 21F of each of the blades 21 on the front side F is joined to the inner surface of the shroud 19. An end edge 21R of each of the blades 21 on the rear side R is joined to the inner surface of the hub 15.

Figure 5A:
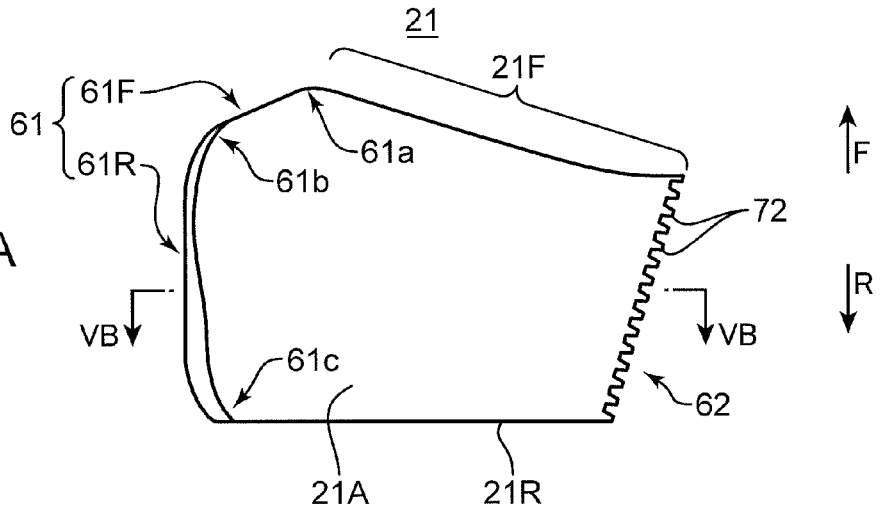
FIG. 5A is a side view of a blade of the impeller.
Figure 5B:
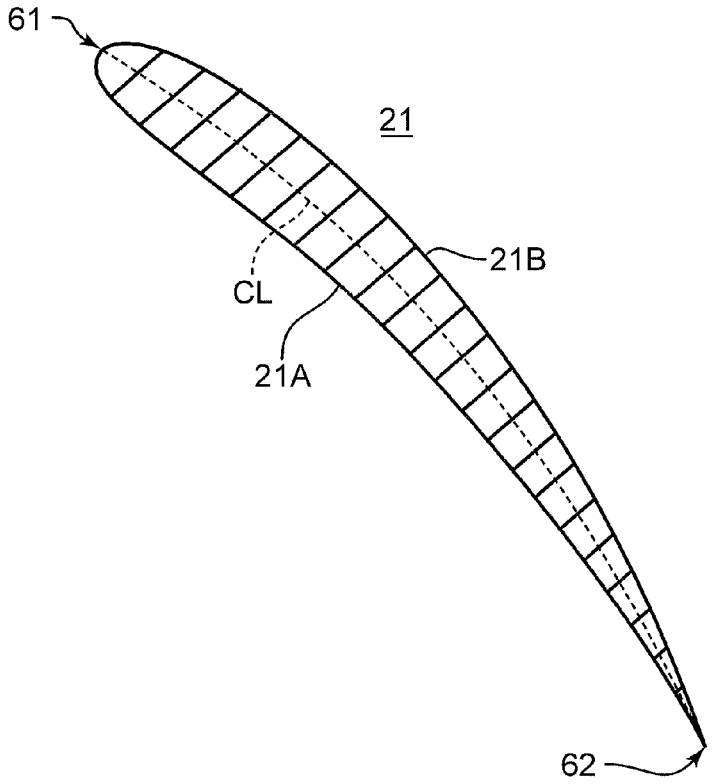
FIG. 5B is a sectional view taken along the line VB-VB in FIG. 5A.

As illustrated in FIG. 4, and FIG. 5A, the front edge 61 of the blade 21 includes a front area 61F and a rear area 61R. The front edge 61 further includes an end 61*a* on the front side F, the other end 61*c* on the rear side R, and a bent portion 61*b* formed between the one end 61*a* and the other end 61*c*. The front area 61F is an area from the one end 61*a* to the bent portion 61*b*, and the rear area 61R is an area from the other end 61*c* to the bent portion 61*b*. The one end 61*a* of the front edge 61 is connected to an end of the end edge 21F. The other end 61*c* of the front edge 61 is connected to an end of the end edge 21R. The front edge 61 has a bent shape at the bent portion 61*b*. The tilt angle of the front area 61F with respect to the rotation axis A is larger than the tilt angle of the rear area 61R with respect to the rotation axis A. The front area 61F is tilted in a direction away from the rotation axis A with respect to the rotation axis A, as the front area 61F extends from the bent portion 61*b* toward the one end 61*a*.

In the embodiment, all the blades 21 have the same shape. Specifically, each of the blades 21 has a feature on the blade angle β to be described later in order to reduce noise due to the reflux stream C. In the centrifugal fan 51, not all the blades 21 may have the feature on the blade angle β, but at least one of the blades 21 may have the feature on the blade angle β. It is, however, preferable that all the blades 21 have the feature on the blade angle β to be described later on a shroud 19 side portion of the blade 21 in order to enhance the noise reduction effect.

[Stream of Air]

FIG. 4 is a sectional view for describing a main stream and a reflux stream. When the impeller 23 is rotated by the fan motor 11, air is sucked into the case 33 of the indoor unit 31 through the suction port 39 of the indoor unit 31. The sucked air is guided to the air suction port 19*a* of the shroud 19 of the impeller 23 along the inner circumferential surface of the bell mouth 25. The air of main stream M guided to the air suction port 19*a* along the inner circumferential surface of the bell mouth 25 is ejected to the outside (in a direction away from the rotation axis A) from the impeller 23 by the blades 21 arranged circumferentially between the hub 15 and the shroud 19. A main part of the air ejected from the impeller 23 is blown into the room through the blow-out ports 37 of the indoor unit 31.

A part of air ejected from the impeller 23 is refluxed toward the bell mouth 25 through the space between the outer circumferential surface of the shroud 19 and the case 33 within the case 33 of the indoor unit 31, and forms the reflux stream C (a leakage stream C) passing through the gap G between the outer circumferential surface of the bell mouth 25 and the inner circumferential surface of the shroud 19. The reflux stream C merges with the main stream M after passing through the gap G.

[Blade Shape]

Figure 6:
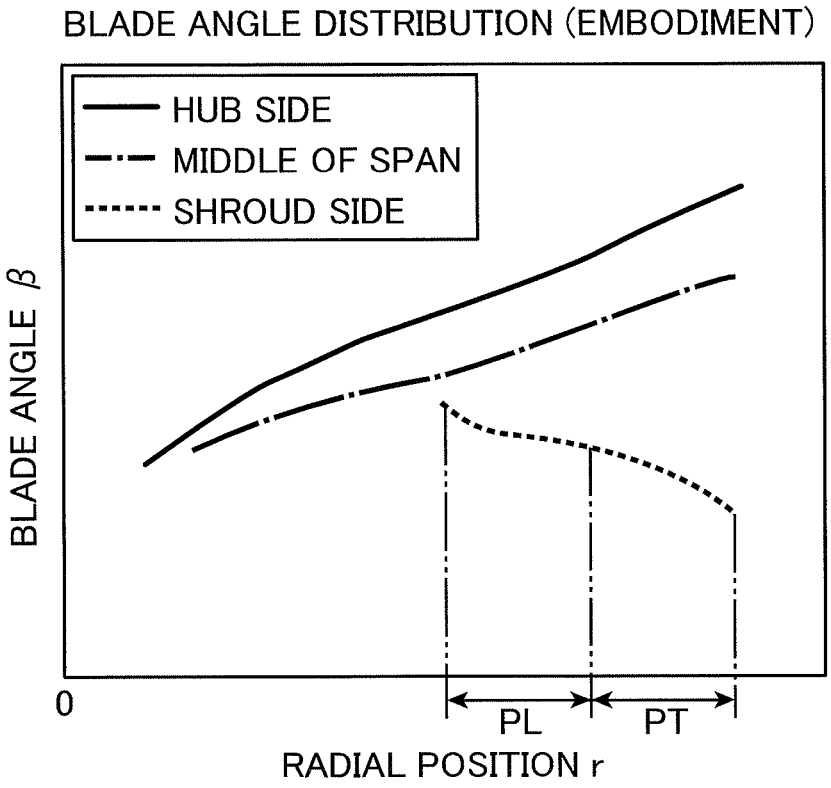
FIG. 6 is a graph illustrating a relationship between the radial position and the blade angle of the blade in the embodiment.
Figure 7A:
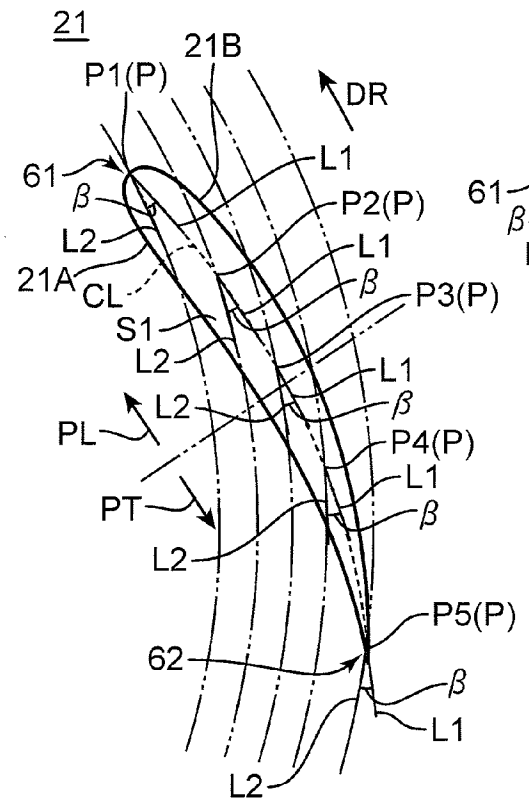
FIG. 7A is a sectional view illustrating a shroud-side blade section in the embodiment.
Figure 7B:
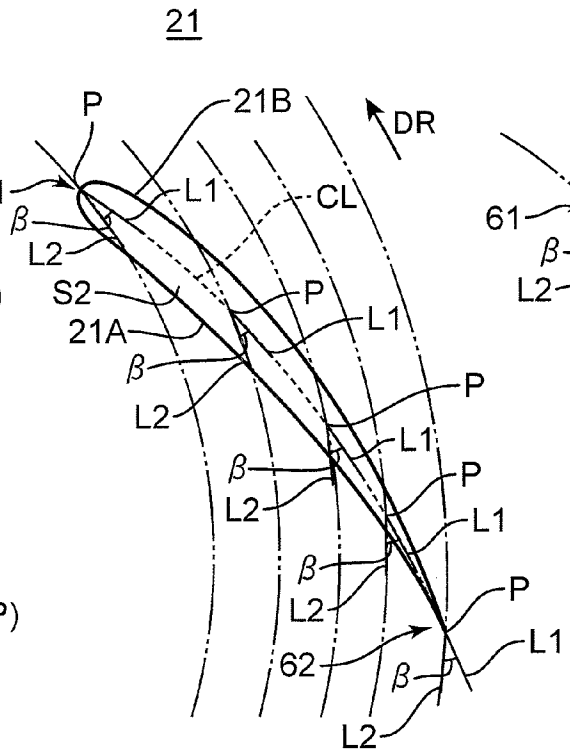
FIG. 7B is a sectional view illustrating a blade section at the middle of the span in the embodiment.
Figure 7C:
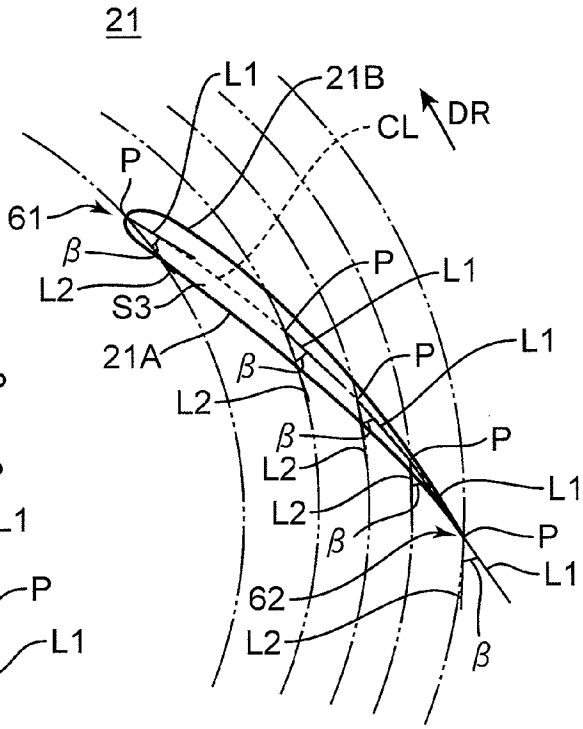
FIG. 7C is a sectional view illustrating a hub-side blade section in the embodiment.

FIG. 6 is a graph illustrating a relationship between the radial position r and the blade angle β of the blade 21 in the embodiment. FIG. 7A is a sectional view illustrating a shroud-19-side blade cross section S1 in the embodiment. FIG. 7B is a sectional view illustrating a blade cross section S2 at the middle of the span (at the middle of the blade height in the rotation axis A direction) in the embodiment. FIG. 7C is a sectional view illustrating a hub-side blade cross section S3 in the embodiment. The horizontal axis of the graph illustrated in FIG. 6 denotes the radial position r of an arc around the rotation axis A. The origin O side of the horizontal axis is the front edge 61 side of the blade 21, and the side away from the origin O of the horizontal axis is the rear edge 62 side of the blade 21. The arc around the rotation axis A is indicated by the two-dotted chain line in FIG. 7A to FIG. 7C, for instance.

In the embodiment, it is assumed that the angle defined by the tangential line L1 to the camber line CL at the intersection point P between the camber line CL and an arc around the rotation axis A, and the tangential line L2 to the arc at the intersection point P on a blade cross section passing the front edge 61 and the rear edge 62 of the blade 21 is the blade angle β. The camber line CL is indicated by the broken line in each of FIG. 7A to FIG. 7C.

The broken line indicating the blade angle β of the shroud 19 side portion of the blade 21 in FIG. 6 indicates a change in the blade angle β when the intersection point P is shifted from the front edge 61 to the rear edge 62 on the camber line CL on the shroud-19-side blade cross section S1 illustrated in FIG. 7A. In the sectional view of FIG. 7A, five intersection points P1 to P5 are illustrated as the intersection point P. However, the broken line illustrated in FIG. 6 is a line obtained by plotting the blade angle β at multitudes of intersection points P including the intersection points P1 to P5.

Figure 9:
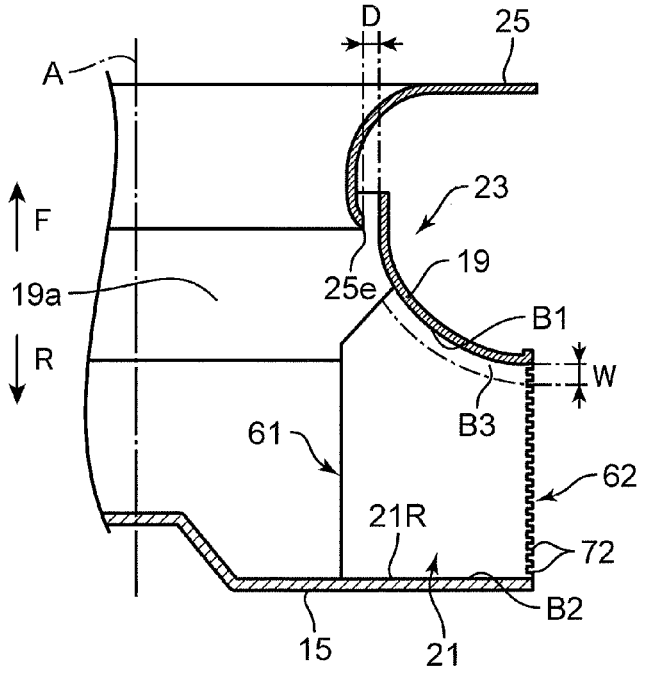
FIG. 9 is a sectional view for describing a distance between an end of a bell mouth and a shroud, and an area having a predetermined width from a boundary portion between the shroud and the blade in a direction away from the shroud.

Further, the shroud-19-side blade cross section S1 illustrated in FIG. 7A is a blade cross section of a boundary portion B1 between the shroud 19 and the blade 21 illustrated in FIG. 9 (joint portion B1 between the shroud 19 and the blade 21). Specifically, the shroud-19-side blade cross section S1 is a blade cross section of the boundary portion B1 between the inner circumferential surface of the shroud 19 and the end edge 21F of the blade 21 on the front side F. The blade cross section S1 illustrated in FIG. 7A is a blade cross section obtained by projecting a blade cross section of the boundary portion B1, which is curved along the inner circumferential surface of the shroud 19 on a plane orthogonal to the rotation axis A in the rotation axis A direction.

Further, the hub-15-side blade cross section S3 illustrated in FIG. 7C is a blade cross section of a boundary portion B2 between the hub 15 and the blade 21 illustrated in FIG. 9 (joint portion B2 between the hub 15 and the blade 21). Specifically, the hub-15-side blade cross section S3 is a blade cross section of the boundary portion B2 between the inner surface of the hub 15, and the rear edge 21R of the blade 21 on the rear side R. In the embodiment, the end edge 21R of the blade 21 on the rear side R and the inner surface of the hub jointed to the end edge 21R are plane orthogonal to the rotation axis A. When the end edge 21R of the blade 21 on the rear side R is curved, it is possible to obtain the blade cross section S3 illustrated in FIG. 7C by projecting a blade cross section of the boundary portion B2, which is curved along the end edge 21R, on a plane orthogonal to the rotation axis A in the rotation axis A direction.

Further, the blade cross section S2 at the middle of the span illustrated in FIG. 7B is a blade cross section at the middle of the blade height in the rotation axis A direction. Specifically, the blade cross section S2 is a blade cross section obtained by cutting the blade 21 along a plane passing through the middle of the blade height of the rear edge 62 of the blade 21, and orthogonal to the rotation axis A.

Further, in the embodiment, as illustrated in FIG. 6 and FIG. 7A, the area of the blade 21 closer to the front edge 61 than the intermediate point (middle) of the length of the camber line CL on the blade cross section S1 is called as a front-edge-61-side portion PL of the blade cross section S1. The area of the blade 21 closer to the rear edge 62 than the intermediate point (middle) of the length of the camber line CL on the blade cross section S1 is called as a rear-edge-62-side portion PT of the blade cross section S1.

As illustrated by the broken line in FIG. 6, the blade 21 has a decreasing shape such that the blade angle β decreases as the intersection point P is shifted toward the rear edge 62 on the camber line CL on the front edge 61-side portion PL of the shroud-19-side blade cross section S1.

Forming the blade 21 to have the aforementioned decreasing shape on the front-edge-61-side portion PL of the shroud-19-side blade cross section S1 makes it possible to form a shroud-19-side area on the negative pressure surface 21A of the blade 21 where the negative pressure is high at a position away from the front edge and on the rear edge side.

Figure 8:
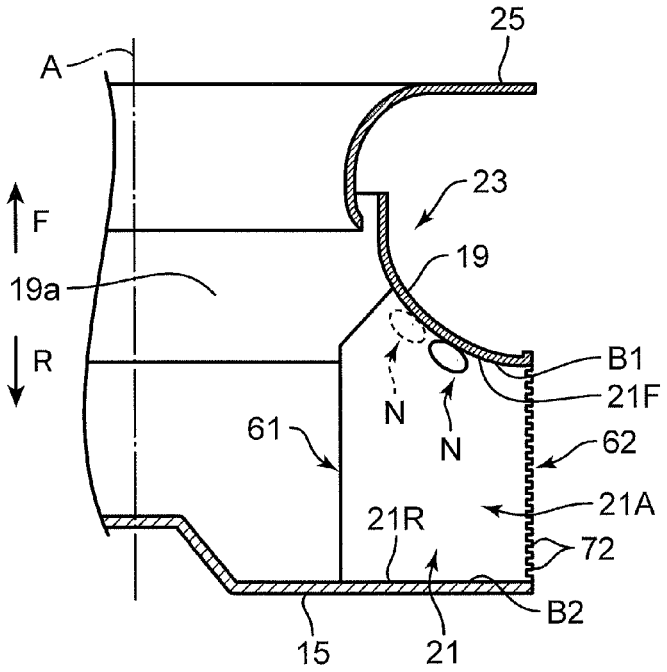
FIG. 8 is a sectional view for describing that an area where the negative pressure is high is formed at a position away from a front edge and on the rear edge side.

FIG. 8 is a sectional view for describing that an area N where the negative pressure is high is formed at a position away from the front edge and on the rear edge side. In FIG. 8, the solid line circle on the negative pressure surface 21A indicates the area N where the negative pressure is high in the embodiment, and the broken line circle on the negative pressure surface 21A indicates an area N of a blade where the negative pressure is high in a conventional centrifugal fan to be described later. As illustrated in FIG. 8, in the embodiment, the blade 21 has the aforementioned decreasing shape on the front-edge-61-side portion PL of the shroud-19-side blade cross section S1. This makes it possible to form the area N on the negative pressure surface 21A of the blade 21 where the negative pressure is high at a position away from the front edge 61 and on the rear edge 62 side, unlike a conventional configuration. Thus, in the embodiment, it is possible to weaken the force of sucking the reflux stream C. According to this configuration, the flow rate of the reflux stream C decreases. This makes it possible to reduce noise due to the reflux stream C (noise caused by interference between the main stream and the reflux stream).

The area N on the negative pressure surface 21A of the blade 21 where the negative pressure is high coincides with the area where the negative pressure is highest. The invention, however, is not limited to the above. In the embodiment, as far as it is possible to form the area N on the negative pressure surface 21A where the negative pressure is high at a position closer to the rear edge 62, another area where the negative pressure is higher than the negative pressure on the aforementioned area N may be formed on the rear-edge-62-side portion PT, for instance.

Further, in the embodiment illustrated in FIG. 6, the blade 21 has such a shape that the blade angle β continues to decrease from the front edge 61 to the rear edge 62 on the shroud-19-side blade cross section S1. As described above, in the embodiment, the blade 21 has a shape such that the blade angle β continues to decrease. Therefore, for instance, as compared with a configuration in which the blade angle β increases on the rear-edge-62-side portion, it is easy for airstreams to follow up to the rear edge 62 on the negative pressure surface. This is advantageous in suppressing separation of airstreams in the vicinity of the rear edge 62.

Further, in the embodiment illustrated in FIG. 6, the blade 21 includes an area where the degree of decrease of the blade angle β decreases, as the intersection point P is shifted from the front edge 61 toward the rear edge 62 on the camber line CL on the front-edge-61-side portion PL of the shroud-19-side blade cross section S1. Specifically, as illustrated in FIG. 6, on the front-edge-61-side portion PL of the blade cross section S1, the broken line indicating the blade angle β includes a curve which is convex leftward and downward. Specifically, the gradient extending in the obliquely rightward and downward direction on the former half area of the front-edge-61-side portion PL (area closer to the origin O) is larger than the gradient extending in the obliquely rightward and downward direction on the latter half area of the front-edge-61-side portion PL (area farther away from the origin O). As described above, in the embodiment, the blade 21 is configured such that the gradient of decrease of the blade angle β on the area closer to the front edge 61 is made relatively large within the front-edge-61-side portion PL, and the blade 21 includes an area where the gradient of decrease of the blade angle β decreases toward the rear edge 62 on the front-edge-61-side portion PL. Specifically, locally increasing the degree of decrease of the blade angle β on the area closer to the front edge 61 is advantageous in enhancing the effect of forming an area where the negative pressure is high at a position away from the front edge 61 and on the rear edge 62 side. Meanwhile, forming an area where the degree of decrease of the blade angle β is moderate toward the rear edge 62 makes it possible to prevent an excessive decrease in the shroud-19-side blade load on the negative pressure surface. This is advantageous in keeping the shroud-19-side blade load to a certain degree of force on the negative pressure surface.

In the embodiment illustrated in FIG. 6, the degree of decrease of the blade angle β decreases, as the intersection point P is shifted from the front edge 61 toward the rear edge 62 on the camber line CL substantially on the entire area of the front-edge-61-side portion PL of the shroud-19-side blade cross section S1. Alternatively, the area where the degree of decrease of the blade angle β decreases may not be formed on the entire area of the front-edge-61-side portion PL, but may be formed only on a part of the front-edge-61-side portion PL.

For instance, in the second modification illustrated in FIG. 10B to be described later, the area where the degree of decrease of the blade angle β decreases on the front-edge-61-side portion PL is not formed on the entire area of the front-edge-61-side portion PL. The area where the degree of decrease of the blade angle β decreases on the front-edge-61-side portion PL is not formed on the latter half area of the front-edge-61-side portion PL, but is formed on the former half area of the front-edge-61-side portion PL. On the latter half area of the front-edge-61-side portion PL, the blade angle β does not decrease even if the intersection point P is shifted toward the rear edge 62 on the camber line CL, but is made constant.

Further, in the embodiment described in FIG. 6, the rear-edge-62-side portion PT on the shroud-19-side blade cross section S1 includes an area where the degree of decrease of the blade angle β increases, as the intersection point P is shifted toward the rear edge 62 on the camber line CL. Specifically, as illustrated in FIG. 6, on the rear-edge-62 side portion PT of the blade cross section S1, the broken line indicating the blade angle β is a curve which is convex rightward and upward. Specifically, the gradient extending in the obliquely rightward and downward direction on the latter half area of the rear-edge-62-side portion PT (the area farther away from the origin O) is larger than the gradient extending in the obliquely rightward and downward direction on the former half area of the rear-edge-62-side portion PT (the area closer to the origin O). As described above, forming an area where the degree of decrease of the blade angle β increases on the rear-edge-62-side portion PT makes it easy for airstreams to follow the negative pressure surface on the rear-edge-62-side portion PT. This is advantageous in preventing separation of airstreams on the rear-edge-62-side portion PT.

In the embodiment illustrated in FIG. 6, the degree of decrease of the blade angle β increases, as the intersection point P is shifted toward the rear edge 62 on the camber line CL substantially on the entire area of the rear-edge-62-side portion PT on the shroud-19-side blade cross section S1. Alternatively, an area where the degree of decrease of the blade angle β increases may not be formed on the entire area of the rear-edge-62-side portion PT, but may be formed only on a part of the rear-edge-62-side portion PT.

For instance, in the second modification illustrated in FIG. 10B to be described later, on the rear-edge-62-side portion PT, an area where the degree of decrease of the blade angle β increases is not formed on the entire area of the rear-edge-62-side portion PT. The area where the degree of decrease of the blade angle β increases is not formed on the former half area of the rear-edge-62-side portion PT, but is formed on the latter half area of the rear-edge-62-side portion PT. On the former half area of the rear-edge-62-side portion PT, the blade angle β does not decrease, even if the intersection point P is shifted toward the rear edge 62 on the camber line CL, but is made constant.

In the embodiment, the shroud-19-side blade cross section S1 illustrated in FIG. 7A may not necessarily be a blade cross section of the boundary portion B1 between the shroud 19 and the blade 21. As far as the blade cross section 21 is a shroud-19-side blade cross section of the blade 21, the blade cross section S1 is not specifically limited. In the embodiment, the shroud-19-side portion of the blade 21 may be the following area. Specifically, as illustrated in FIG. 9, the shroud-19-side portion of the blade 21 may be an area B3 having a predetermined width W from the boundary portion B1 between the shroud 19 and the blade 21 in a direction away from the shroud 19. The predetermined width W is substantially equal to the distance D between an end 25*e* of the bell mouth 25 and the shroud 19. A blade cross section which passes the front edge 61 and the rear edge 62 and is formed along the boundary portion B1 between the shroud 19 and the blade 21 may be selected within the area B3, and a blade cross section obtained by projecting the selected blade cross section on a plane orthogonal to the rotation axis A in the rotation axis A direction may be set as the blade cross section S1.

Providing the feature on the blade angle β on the shroud-19-side portion of the blade 21 as described above is advantageous in weakening the force of sucking the reflux stream C. Specifically, the following advantageous effects are obtained. The width of the reflux stream C immediately after the reflux stream C passes through the gap G between the outer circumferential surface of the bell mouth 25 and the inner circumferential surface of the shroud 19 is substantially equal to the distance D between the end 25*e* of the bell mouth 25 and the inner circumferential surface of the shroud 19. The reflux stream C impinges on the blade 21 shortly after passing through the gap G. Therefore, the area of the blade 21 affected by the reflux stream C is associated with the width of the reflux stream C. In view of the above, providing the aforementioned feature on the blade angle β on the area B3 having the predetermined width W, which is substantially equal to the distance D between the end 25*e* of the bell mouth 25 and the shroud 19, is advantageous in weakening the force of sucking the reflux stream C.

Preferably, the blade cross section S1 obtained by projecting a selected blade cross section on a plane orthogonal to the rotation axis A in the rotation axis A direction may have the aforementioned feature on the blade angle β, even if any blade cross section along the boundary portion B1 is selected within the area B3.

Further, in the embodiment, the solid line indicating the blade angle β of the hub-15-side portion in FIG. 6 indicates a change in the blade angle β when the intersection point P is shifted from the front edge 61 to the rear edge 62 on the camber line CL on the hub-15-side blade cross section S3 in FIG. 7C. As illustrated in FIG. 6, the blade angle β of the hub-15-side portion is illustrated by a line (curve) extending in the obliquely rightward and upward direction, and increases as the intersection point is shifted from the front edge 61 toward the rear edge 62. The invention, however, is not limited to the above.

Further, in the embodiment, the one-dotted chain line indicating the blade angle β at the middle of the span in FIG. 6 indicates a change in the blade angle β when the intersection point P is shifted from the front edge 61 to the rear edge 62 on the camber line CL on the blade cross section S2 at the middle of the span in FIG. 7B. As illustrated in FIG. 6, the blade angle β at the middle of the span is illustrated by a line (curve) extending in the obliquely rightward and upward direction, and increases as the intersection point is shifted from the front edge 61 toward the rear edge 62. The invention, however, is not limited to the above.

Figure 11:
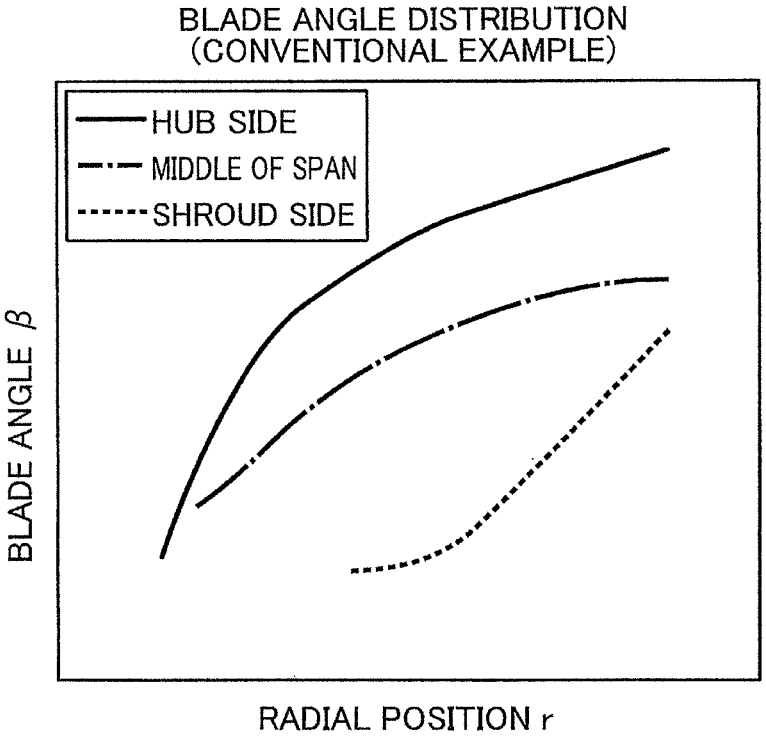
FIG. 11 (PRIOR ART)
FIG. 11 is a graph illustrating a relationship between the radial position and the blade angle of a blade in a conventional centrifugal fan.
Figures 12A, 12B, 12C:
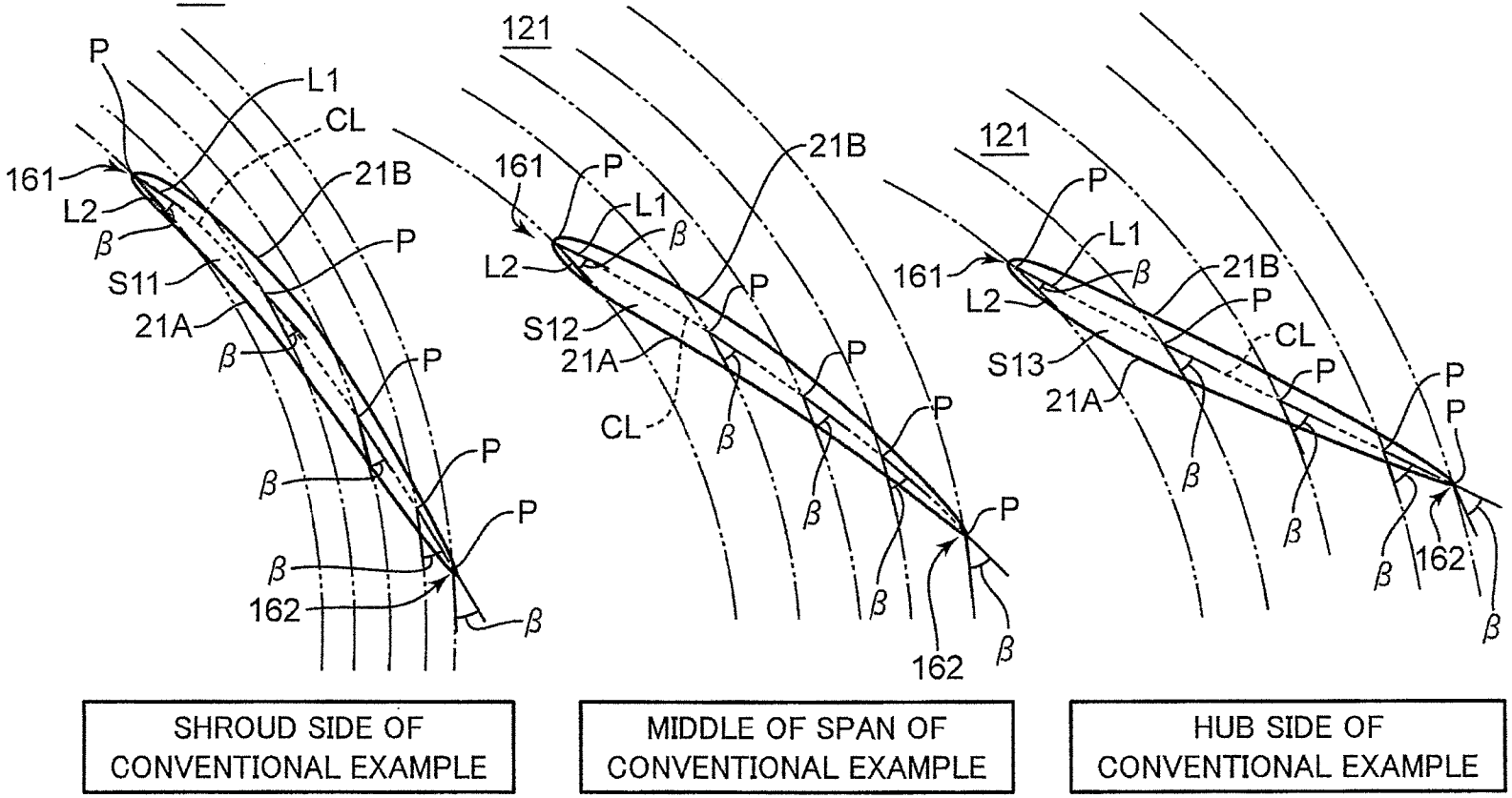
FIG. 12A (PRIOR ART)
FIG. 12B (PRIOR ART)
FIG. 12C (PRIOR ART)
FIG. 12A is a sectional view illustrating a shroud-side blade section in the conventional centrifugal fan.
FIG. 12B is a sectional view illustrating a blade section at the middle of the span in the conventional centrifugal fan.
FIG. 12C is a sectional view illustrating a hub-side blade section in the conventional centrifugal fan.

Next, the feature on a blade 121 in a conventional centrifugal fan is briefly described. FIG. 11 is a graph illustrating a relationship between the radial position r and the blade angle β of the blade 121 in a conventional centrifugal fan. FIG. 12A is a sectional view illustrating a shroud-side blade cross section S11 in the conventional centrifugal fan. FIG. 12B is a sectional view illustrating a blade cross section S12 at the middle of the span in the conventional centrifugal fan. FIG. 12C is a sectional view illustrating a hub-side blade cross section S13 in the conventional centrifugal fan.

The broken line indicating the blade angle β of the shroud side portion in FIG. 11 indicates a change in the blade angle β when the intersection point P is shifted from a front edge 161 to a rear edge 162 on the camber line CL on the shroud-side blade cross section S11 in FIG. 12A. The one-dotted chain line indicating the blade angle β at the middle of the span in FIG. 11 indicates a change in the blade angle β when the intersection point P is shifted from the front edge 161 to the rear edge 162 on the camber line CL on the blade cross section S12 at the middle of the span in FIG. 12B. The solid line indicating the blade angle β of the hub side portion in FIG. 11 indicates a change in the blade angle β when the intersection point P is shifted from the front edge 161 to the rear edge 162 on the camber line CL on the hub-side blade cross section S13 in FIG. 12C. The blade cross sections S11 to S13 are blade cross sections at the same positions as the blade cross sections S1 to S3 in the embodiment.

As illustrated in FIG. 11, in the conventional centrifugal fan, in any one of the shroud-side blade cross section S11 of the blade 121, the blade cross section S12 at the middle of the span of the blade 121, and the hub-side blade cross section of the blade 121, the blade angle β is illustrated by a line (curve) extending in the obliquely rightward and upward direction, and increases as the intersection point is shifted from the front edge 161 toward the rear edge 162. Therefore, in the conventional centrifugal fan, an area N on the negative pressure surface 21A of the blade 121 where the negative pressure is high is located at a position close to the front edge 161. As a result, unlike the embodiment, the reflux stream is sucked with a large force. Consequently, as compared with the embodiment, the flow rate of the reflux stream increases and noise due to the reflux stream increases.

[Modifications]

In the foregoing, an embodiment of the invention is described. The invention, however, is not limited to the embodiment. Various modifications and improvements are applicable as far as such modifications and improvements do not depart from the gist of the invention.

In the embodiment illustrated in FIG. 6, the blade 21 has such a shape that the blade angle β continues to decrease from the front edge 61 to the rear edge 62 on the shroud-19-side blade cross section S1. The invention, however, is not limited to the above. For instance, the blade 21 may have the shapes of the first to fifth modifications illustrated in FIG. 10A to FIG. 10E. In FIG. 10A to FIG. 10E, only the blade angle β on the shroud-19-side blade cross section S1 is illustrated, and illustration of the blade angle β on the blade cross section S2 at the middle of the span, and the blade angle β on the hub-15-side blade cross section S3 is omitted.

Figure 10A:
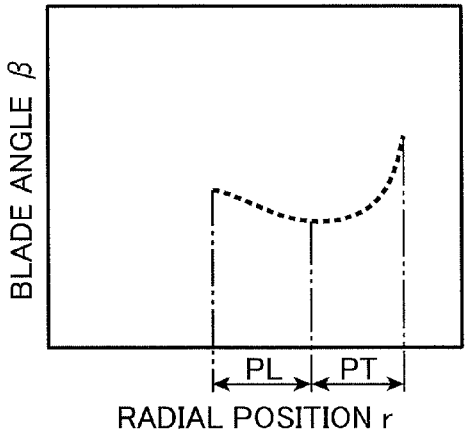
FIG. 10A is graph illustrating relationships between the radial position and the blade angle of a blade in the first modification of the embodiment.

The blade 21 of the first modification illustrated in FIG. 10A has a decreasing shape such that the blade angle β decreases, as the intersection point P is shifted toward the rear edge 62 on the camber line CL on the front-edge-61-side portion PL of the shroud-19-side blade cross section S1, and has an increasing shape such that the blade angle β increases, as the intersection point P is shifted toward the rear edge 62 on the camber line CL on the rear-edge-62-side portion PT of the shroud-19-side blade cross section S1.

Figure 10D:
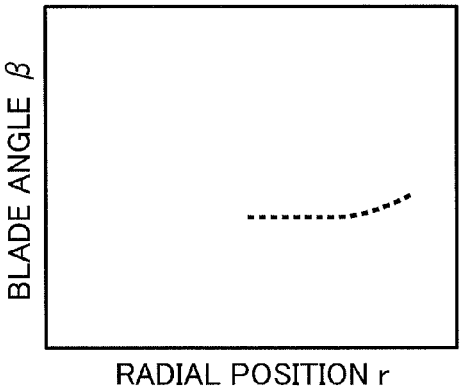
FIG. 10D is graph illustrating relationships between the radial position and the blade angle of a blade in the fourth modification of the embodiment.
Figure 10B:
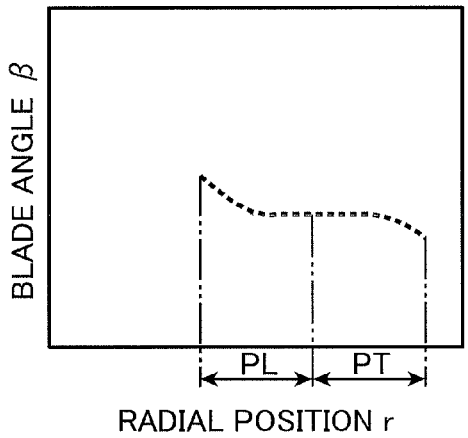
FIG. 10B is graph illustrating relationships between the radial position and the blade angle of a blade in the second modification of the embodiment.
Figure 10E:
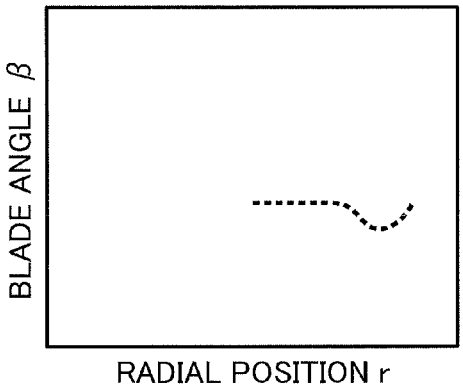
FIG. 10E is graph illustrating relationships between the radial position and the blade angle of a blade in the fifth modification of the embodiment.
Figure 10C:
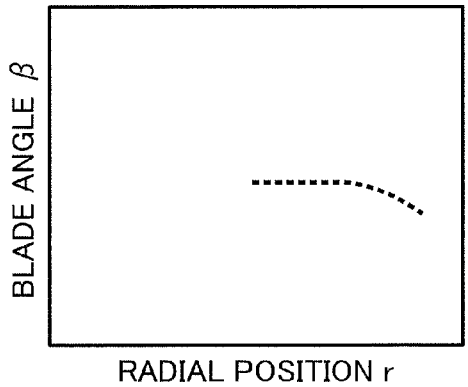
FIG. 10C is graph illustrating relationships between the radial position and the blade angle of a blade in the third modification of the embodiment.

The blade 21 of each one of the third to fourth modifications illustrated in FIG. 10C to FIG. 10D has a fixed shape such that the blade angle β is fixed even if the intersection point P is shifted toward the rear edge 62 on the camber line CL on the front-edge-61-side portion PL of the shroud-19-side blade cross section S1.

The blade 21 of each one of the third to fifth modifications illustrated in FIG. 10C to FIG. 10D has a fixed shape such that the blade angle β is fixed even if the intersection point P is shifted toward the rear edge 62 on the camber line CL on the front-edge-61-side portion PL of the shroud-19-side blade cross section S1.

The blade 21 of the third modification illustrated in FIG. 10C includes an area where the blade angle β decreases, as the intersection point P is shifted toward the rear edge 62 on the camber line CL on the rear-edge-62-side portion PT of the shroud-19-side blade cross section S1.

The blade 21 of the fourth modification illustrated in FIG. 10D includes an area where the blade angle β increases, as the intersection point P is shifted toward the rear edge 62 on the camber line CL on the rear-edge-62-side portion PT of the shroud-19-side blade cross section S1.

The blade 21 of the fifth modification illustrated in FIG. 10E includes an area where the blade angle β decreases, as the intersection point P is shifted toward the rear edge 62 on the camber line CL, and an area where the blade angle β increases, as the intersection point P is shifted toward the rear edge 62 on the camber line CL, on the rear-edge-62-side portion PT of the shroud-19-side blade cross section S1.

Further, in the embodiment, all the blades 21 have the same shape. The invention, however, is not limited to the above. Any configuration is applicable, as far as at least one of the blades 21 has the decreasing shape, the fixed shape, or a shape obtained by combining the decreasing shape and the fixed shape.

Further, the embodiment is applied to a case, in which the centrifugal fan 51 is incorporated in a ceiling-embedded indoor unit. The invention, however, is not limited to the above. The inventive centrifugal fan is also applicable to the other types of indoor units such as indoor units installed at a high place including ceiling-suspended indoor units, air handling units, or rooftop units; and indoor units placed on the floor.

The following is a summary of the foregoing embodiment.

The centrifugal fan of the embodiment comprises an impeller rotating around a rotation axis and a bell mouth guiding air to the impeller. The impeller includes a shroud provided to have a gap between the shroud and an end of the bell mouth in a circumferential direction and a plurality of blades arranged along a circumferential direction of the shroud, and assembled to the shroud.

In a blade cross section passing a front edge of the blade and a rear edge of the blade, when an angle between a tangential line to a camber line at an intersection point of the camber line and an arc around the rotation axis, and a tangential line to the arc at the intersection point is defined as a blade angle, the blade has at least one of a decreasing shape and a fixed shape. The decreasing shape being such that the blade angle decreases as the intersection point is shifted toward the rear edge side on the camber line in a portion of the front edge side in the blade cross section of the shroud side. The fixed shape being such that the blade angle is fixed even if the intersection point is shifted toward the rear edge side on the camber line in a portion of the front edge side in the blade cross section of the shroud side.

According to the aforementioned configuration, the blade has at least one of the decreasing shape and the fixed shape in a portion of the front edge side in the blade cross section of the shroud side. The camber line, which is an element that defines the blade angle, is a line connecting positions on the blade cross section equally distanced away from a positive pressure surface and a negative pressure surface. Because the blade has at least one of the decreasing shape and the fixed shaped in a portion of the front edge side in the blade cross section of the shroud side, it becomes possible to weaken the blade load of a shroud side and front edge side portion on the negative pressure surface of the blade. Thus, it is possible to form an area on the negative pressure surface of the blade where the negative pressure is high at a position away from the front edge and on the rear edge side. Therefore, it is possible to weaken the force of sucking a reflux stream (a leakage stream). Thus, it is possible to reduce the flow rate of the reflux stream. This is advantageous in reducing noise due to the reflux stream (noise caused by interference between the main stream and the reflux stream).

Further, in the embodiment, it is possible to reduce noise due to a reflux stream without adding small blades, unlike the conventional art. This is advantageous in suppressing an increase in the weight and the cost.

In the embodiment, a portion of the front edge side in the blade cross section is a portion closer to the front edge than the intermediate point of the camber line, and a portion of the rear edge side in the blade cross section is a portion closer to the rear edge than the intermediate point of the camber line.

In the centrifugal fan, the blade may have a shape combining the decreasing shape and the fixed shape in a portion of the front edge side in the blade cross section of the shroud side.

In the centrifugal fan, preferably, the blade has a shape such that the blade angle continues to decrease from the front edge to the rear edge in the blade cross section of the shroud side.

In the aforementioned configuration, the blade has such a shape that the blade angle continues to decrease. Therefore, as compared with a configuration, in which the blade angle increases in a portion of the rear edge side, for instance, the aforementioned configuration makes it easy for airstreams to follow up to the rear edge on the negative pressure surface. This is advantageous in suppressing separation of airstreams in the vicinity of the rear edge.

In the centrifugal fan, preferably, the blade is provided with an area where a degree of decrease of the blade angle decreases as the intersection point is shifted from the front edge toward the rear edge on the camber line in a portion of the front edge side in the blade cross section of the shroud side.

In the aforementioned configuration, the blade is configured such that the gradient of decrease of the blade angle on the area closer to the front edge is made relatively large within the portion of the front edge side, and the blade includes an area where the gradient of decrease of the blade angle decreases toward the rear edge in the portion of the front edge side. Specifically, locally increasing the degree of decrease of the blade angle on the area closer to the front edge makes it possible to enhance the effect of forming an area where the negative pressure is high at a position away from the front edge and on the rear edge side. Meanwhile, forming an area where the degree of decrease of the blade angle is moderate toward the rear edge makes it possible to prevent an excessive decrease in the shroud-side blade load on the negative pressure surface. This is advantageous in keeping the shroud-side blade load to a certain degree of force on the negative pressure surface.

In the centrifugal fan, preferably, the blade is provided with an area where a degree of decrease of the blade angle increases as the intersection point is shifted toward the rear edge on the camber line in a portion of the rear edge side in the blade cross section of the shroud side.

According to the aforementioned configuration, making the degree of decrease of the blade angle large on the portion of the rear edge side makes it easy for airstreams to follow the negative pressure surface on the portion of the rear edge side. This is advantageous in suppressing separation of airstreams on the rear-edge-side portion.

In the centrifugal fan, a shroud side portion of the blade may be the following area, for instance. Specifically, the shroud side portion of the blade may be an area having a predetermined width from a boundary portion between the shroud and the blade in a direction away from the shroud, and the predetermined width may be equal to a distance between the end of the bell mouth and the shroud.

Providing the aforementioned feature on the blade angle on the shroud side portion is advantageous in weakening the force of sucking a reflux stream. Specifically, the following advantageous effects are obtained. The width of the reflux stream immediately after the reflux stream passes through the gap between the outer circumferential surface of the bell mouth and the inner circumferential surface of the shroud is substantially equal to the distance between the end of the bell mouth and the inner circumferential surface of the shroud. The reflux stream impinges on the blade shortly after passing through the gap. Therefore, the area of the blade affected by the reflux stream is associated with the width of the reflux stream. In view of the above, providing the aforementioned feature on the blade angle on the area having the predetermined width, which is equal to the distance between the end of the bell mouth and the shroud, is advantageous in weakening the force of sucking the reflux stream.

In the centrifugal fan, preferably, the plurality of blades may have the same shape each other.

In the aforementioned configuration, all the blades have the aforementioned feature on the blade angle on the shroud side portion. This is advantageous in weakening the force of sucking the reflux stream on each of the blades.

The air conditioner of the embodiment is provided with the centrifugal fan having the aforementioned configuration. Therefore, the air conditioner of the embodiment is advantageous in reducing noise.

The invention claimed is:

1. A centrifugal fan, comprising:

an impeller rotating around a rotation axis; and a bell mouth guiding air to the impeller, the impeller including a shroud provided to have a gap between the shroud and an end of the bell mouth in a circumferential direction, and a plurality of blades arranged along a circumferential direction of the shroud, and assembled to the shroud, wherein in a blade cross section passing a front edge of the blade and a rear edge of the blade at the shroud side, wherein arcs, intersection points, and blade angles are defined as follows:

each of the arcs is an arc around the rotation axis of a given radius that extends from a beginning point that is positioned on a front side of a camber line of the blade in a direction of rotation of the blade to an end point that is positioned on a rear side of the camber line in the direction of rotation of the blade such that the arc intersects the camber line, each of the intersection points is a point in which the camber line and a corresponding one of the arcs intersect, and each of the blade angles is an angle between a tangential line to the camber line at a corresponding one of the intersection points and a tangential line to a corresponding one of the arcs at the corresponding intersection point, in the blade cross section of the shroud side, a portion of the blade that is closer to the front edge than an intermediate point of the length of the camber line is provided with both of a decreasing area and a fixed area, the decreasing area is an area in which the blade angles decrease as the radii of the corresponding arcs increase, the fixed area is an area in which the blade angles are fixed even if the radii of the corresponding arcs increase.

2. The centrifugal fan according to claim 1, wherein a shroud side portion of the blade is an area having a predetermined width from a boundary portion between the shroud and the blade in a direction away from the shroud, and the predetermined width is equal to a distance between the end of the bell mouth and the shroud.

3. The centrifugal fan according to claim 1, wherein the plurality of blades have the same shape as each other.

4. An air conditioner comprising the centrifugal fan according to claim 1.

5. A centrifugal fan comprising:

an impeller rotating around a rotation axis; and a bell mouth guiding air to the impeller, the impeller including a shroud provided to have a gap between the shroud and an end of the bell mouth in a circumferential direction, and a plurality of blades arranged along a circumferential direction of the shroud, and assembled to the shroud, wherein in a blade cross section passing a front edge of the blade and a rear edge of the blade at the shroud side, wherein arcs, intersection points, and blade angles are defined as follows:

each of the arcs is an arc around the rotation axis of a given radius that extends from a beginning point that is positioned on a front side of a camber line of the blade in a direction of rotation of the blade to an end point that is positioned on a rear side of the camber line in the direction of rotation of the blade such that the arc intersects the camber line, each of the intersection points is a point in which the camber line and a corresponding one of the arcs intersect, and each of the blade angles is an angle between a tangential line to the camber line at a corresponding one of the intersection points and a tangential line to a corresponding one of the arcs at the corresponding intersection point, the blade has a decreasing shape, the decreasing shape being such that the blade angles decrease as the radii of the corresponding arcs increase in a portion of the front edge side in the blade cross section of the shroud side, the blade is provided with an area where a degree of decrease of the blade angles decreases as the radii of the corresponding arcs increase in the portion of the front edge side in the blade cross section of the shroud side.

6. A centrifugal fan comprising:

an impeller rotating around a rotation axis; and a bell mouth guiding air to the impeller, the impeller including a shroud provided to have a gap between the shroud and an end of the bell mouth in a circumferential direction, and a plurality of blades arranged along a circumferential direction of the shroud, and assembled to the shroud, wherein in a blade cross section passing a front edge of the blade and a rear edge of the blade at the shroud side, wherein arcs, intersection points, and blade angles are defined as follows:

each of the arcs is an arc around the rotation axis of a given radius that extends from a beginning point that is positioned on a front side of a camber line of the blade in a direction of rotation of the blade to an end point that is positioned on a rear side of the camber line in the direction of rotation of the blade such that the arc intersects the camber line, each of the intersection points is a point in which the camber line and a corresponding one of the arcs intersect, and each of the blade angles is an angle between a tangential line to the camber line at a corresponding one of the intersection points and a tangential line to a corresponding one of the arcs at the corresponding intersection point, in the blade cross section of the shroud side, a portion of the blade that is closer to the front edge than an intermediate point of the length of the camber line is provided with at least one of a decreasing area and a fixed area, the decreasing area is an area in which the blade angles decrease as the radii of the corresponding arcs increase, the fixed area is an area in which the blade angles are fixed even if the radii of the corresponding arcs increase, in the blade cross section of the shroud side, a portion of the blade that is closer to the rear edge than the intermediate point of the length of the camber line is provided with an area where a degree of decrease of the blade angles increases as the radii of the corresponding arcs increase.

* * * * *